United States Patent [19]

Hayman

[11] Patent Number: 5,072,554

[45] Date of Patent: Dec. 17, 1991

[54] PREFABRICATED MODULAR STORAGE BUILDING

[75] Inventor: Lowell K. Hayman, Ogden, Utah

[73] Assignee: The United States of America as represented by the Secretary of the Air Force, Washington, D.C.

[21] Appl. No.: 515,398

[22] Filed: Apr. 27, 1990

[51] Int. Cl.[5] ..... E04H 9/04; E04H 9/10

[52] U.S. Cl. ..... 52/79.1; 52/79.9; 52/252; 52/601; 52/284; 109/83

[58] Field of Search ..... 52/79.1, 79.9, 581, 52/582, 596, 600, 601, 236.5, 236.9, 250.2, 282, 286; 109/15, 83, 84

[56] References Cited

U.S. PATENT DOCUMENTS

| | | | |
|---|---|---|---|
| 3,353,315 | 11/1967 | Barker | 52/275 |
| 3,461,633 | 8/1969 | Ziegelman et al. | 52/643 |
| 3,591,212 | 7/1971 | Rhyne | 287/20.92 D |
| 3,706,168 | 12/1972 | Pilish | 52/234 |
| 3,830,025 | 8/1974 | Wainshal | 52/79 |
| 3,940,902 | 3/1976 | Reale | 52/79.1 X |
| 3,990,197 | 11/1976 | Johnston | 52/125 |
| 4,018,021 | 4/1977 | Dow | 52/251 |
| 4,044,522 | 8/1977 | Sturner et al. | 52/600 X |
| 4,299,065 | 11/1981 | Fairgrieve | 52/79.7 |
| 4,559,881 | 12/1985 | Lankard et al. | 109/83 |
| 4,726,157 | 2/1988 | Hult et al. | 52/79.5 |
| 4,905,436 | 3/1990 | Matsuo et al. | 52/252 |
| 4,914,874 | 4/1990 | Graham, Jr. | 52/79.1 |

FOREIGN PATENT DOCUMENTS

| | | | |
|---|---|---|---|
| 2264599 | 5/1974 | Fed. Rep. of Germany | 52/236.9 |
| 1500966 | 10/1967 | France | 52/79.1 |

*Primary Examiner*—Richard E. Chilcot, Jr.
*Assistant Examiner*—Kien T. Nguyen
*Attorney, Agent, or Firm*—Jacob N. Erlich; Donald J. Singer

[57] ABSTRACT

A prefabricated modular building is constructed of a plurality of panels which are readily assembled and locked together without the need for tools (other than material handling and earth moving equipment) at the assembly site. The building is constructed of sets of panels, most of the panels in each set being identical.

All of the vertical panels are interlocked by sliding a built in flange on each panel into a built in channel member on an adjacent panel. The vertical structural beams of each panel projects above and below the panels and these projecting ends are received by corresponding spaced receptacles in the horizontal ceiling and floor panels. In addition, an earth barricade on the roof of the building plus wall extensions provide for the covering of the roof and sides of the building with earth.

10 Claims, 10 Drawing Sheets

PREFABRICATED MODULAR STORAGE BUILDING

STATEMENT OF GOVERNMENT INTEREST

The invention described herein may be manufactured and used by or for the Government for governmental purposes without the payment of any royalty thereon.

BACKGROUND OF THE INVENTION

This invention is for a unique prefabricated storage building in which all of the components are interlocked without the use of fasteners. The building is intended primarily for use by the military for ammunition storage and is designed to withstand high forces applied both from within the building and from without. Provisions are included for covering the structure with earth to provide the building with additional integrity and security. The building can be erected on a prepared site within a matter of a few days, whereas erection time for previous designs for similar uses was measured in months, and at much higher costs. While the disclosed modular storage building is intended for storage of munitions, it is useful for general storage when military security is important.

BACKGROUND OF THE INVENTION

No relevant art is known that is comparable to the disclosed invention. Prior art patents revealed by a search of related art include the following U.S. Pat.: Barker patent No. 3,353,315, Ziegelman et al patent No. 3,461,633, Rhyne patent No. 3,591,212, Pilish patent No. 3,706,168, Wainshal patent No. 3,830,025, and Johnston patent No. 3,990,197. Only Wainshal, Johnston, Pilish and Ziegelman et al relate to prefabricated buildings. The remaining patents do not relate to modular buildings.

Ziegelman et al disclosed a building comprised of a welded steel frame which is enclosed by wall, roof and floor panels. The present invention is frameless.

Pilish uses precast panels, but he assembles his building by means of footings which support the various elements in alignment. The present invention requires no footings.

Johnston's building is made up of a unitary "tunnel" structure into which a "flat bed" is slid to form the floor. Applicant's modular building essentially uses all planar panels which are assembled by various interlocking mechanisms.

SUMMARY OF THE INVENTION

This invention is a prefabricated modular building constructed of a plurality of panels which are readily assembled and locked together without the need for tools (other than material handling and earth moving equipment) at the assembly site. The building is constructed entirely of sets of panels, the panels in each set being identical. Thus, for a standard module there are 4 identical floor panels, 4 identical side wall panels, 4 identical roof panels, 1 rear wall panel and 1 front wall panel which is fitted with all of the hardware for mounting the doors. The vertical panels are interlocked by sliding a built in flange on each panel into a built in channel member on an abutting panel. Projecting beams at the tops and bottoms of the vertical panels are received by corresponding spaced receptacles in the horizontal ceiling and floor panels. The roof is "finished" with two identical quarter ceiling panels, one for over the front door panel, and 1 over the rear wall panel. In addition, there is an earth barricade for mounting on either the front or the rear quarter panel, or both, depending on site conditions. Interlocking wings provide stability under extreme conditions, and the entire building, is covered with earth.

DESCRIPTION OF THE PREFERRED EMBODIMENT

Figure 1:
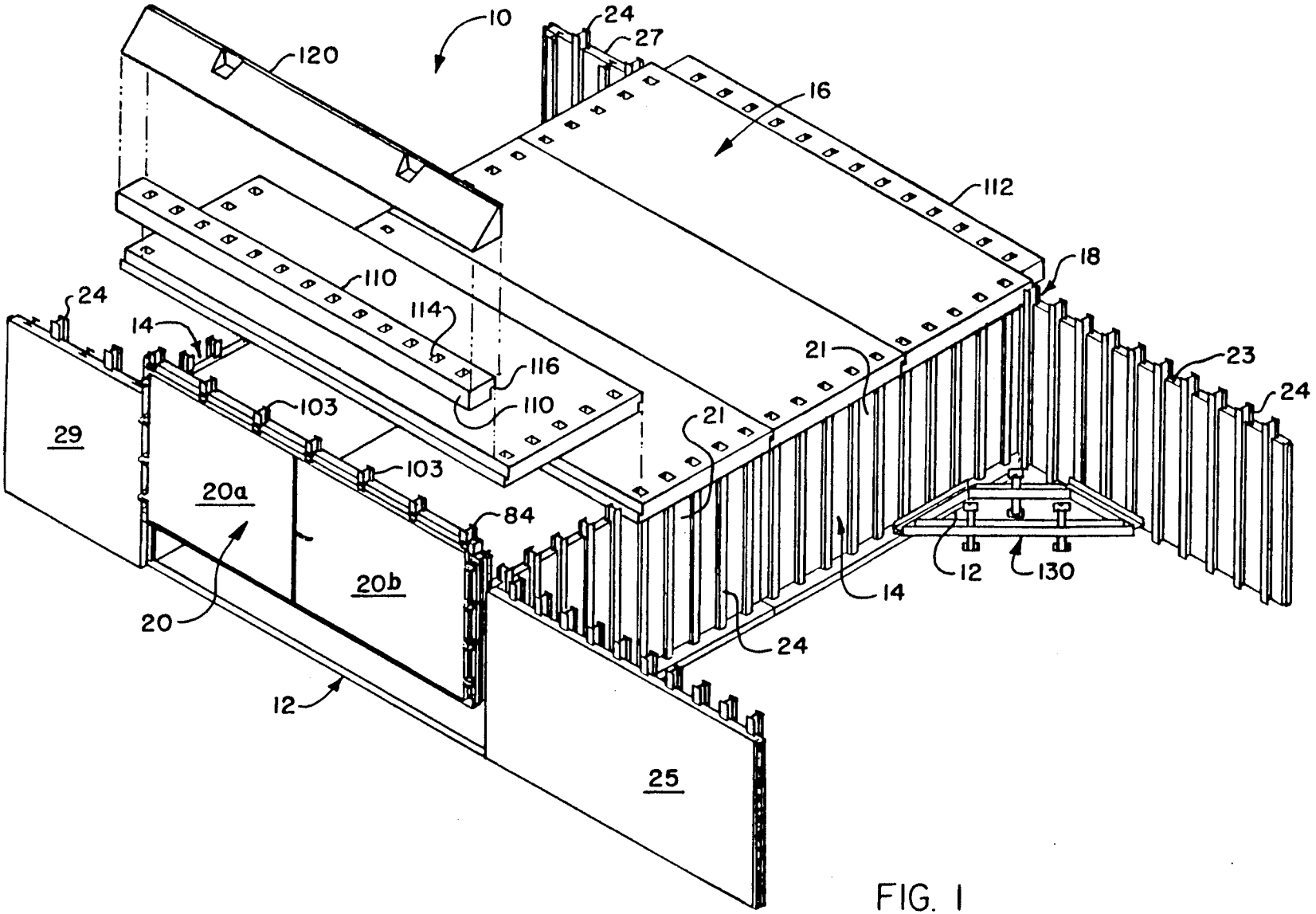
FIG. 1 is a perspective view of a partially assembled modular building.

FIG. 1 is a perspective view of a partially assembled modular building 10 consisting of a floor 12, side walls 14, roof 16, rear wall 18 and front door assembly 20. The assembly of these components is self-supporting without the use of fasteners, and it requires no tools for assembly, except those needed to lift and put the various components in place. Wing wall panels 23, 25, 27 and 29 serve to brace the building and to provide retention for the earth (not illustrated) which covers the top and sides of the building. This configuration is especially useful for military applications as an ammunitions storage building.

Figure 2:
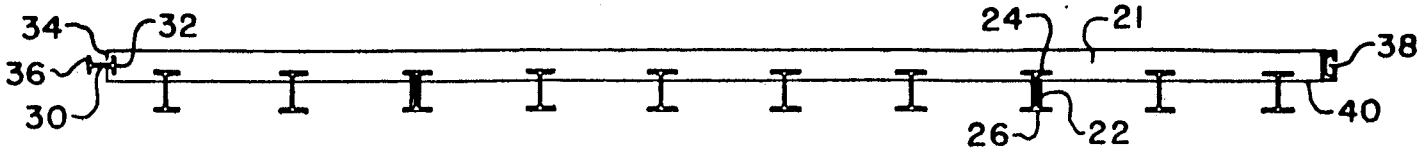
FIGS. 2 and 3 illustrate the reinforced concrete side walls panels.
Figure 3:
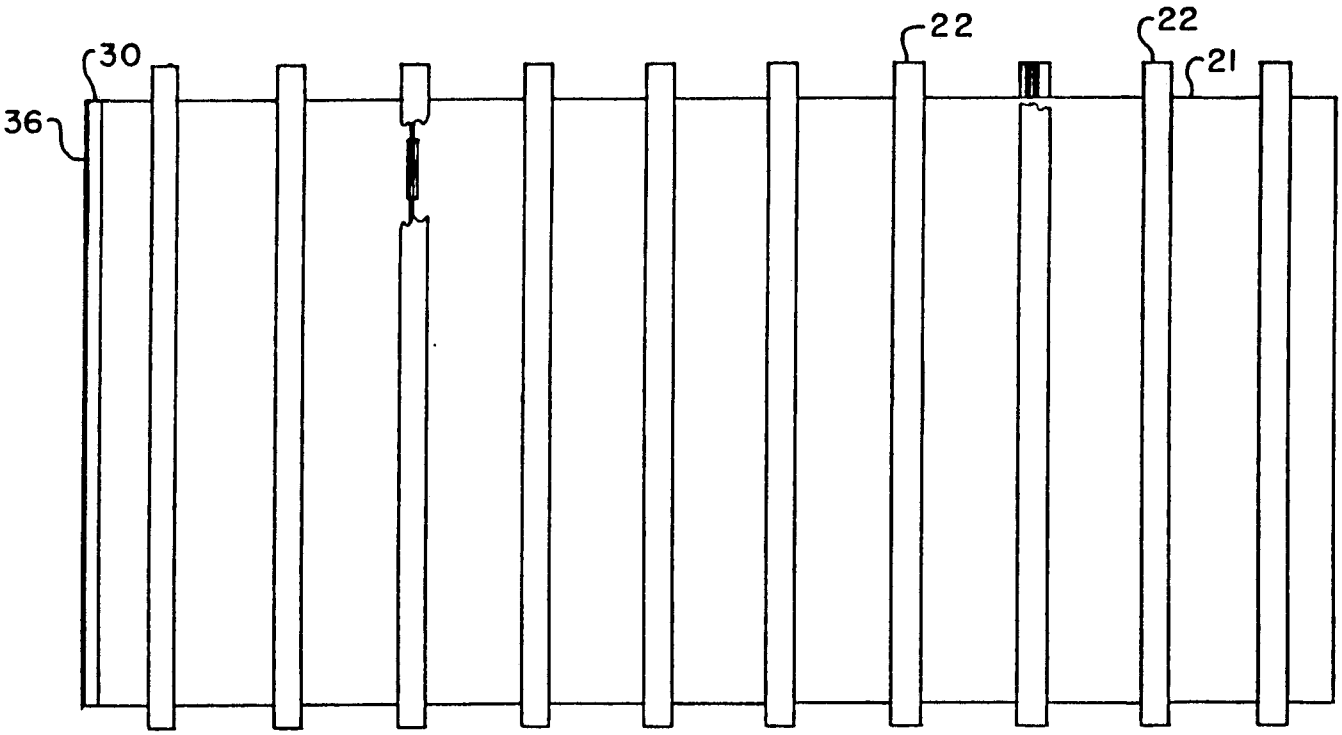

Referring to FIGS. 2 and 3, each side wall 14 comprises two steel reinforced concrete panels 21 in which a plurality of spaced steel I-beams 22 are anchored along the length thereof. As seen in FIG. 2, one flange 24 of each I-beam 22 is embedded within the concrete panel 21, while the other flange 26 extends out of the panel and lies in a plane essentially parallel to the side walls 14. The I-beams 22 are equally spaced, and each extends above and below the panel 21.

To join the side wall panels 21 together, the flange 32 of an I-beam 30 is embedded in and along the entire height of one edge 34 of each panel 21, while the other flange 36 projects from it. A complimentary C-shaped channel member 38 is embedded in the other end 40 of the panels 21. When two such wall panels 21 are assembled, the panels are locked together by sliding the flange 36 into the channel of an adjacent channel member 38. FIG. 1 shows two such side wall panels interconnected between the rear wall 18 and the door assembly 20. It will be understood that the length of the building is determined by the number and length of such panels, and that any number may be used.

The wing wall panels 23 and 25 are identical to the panels 21. Wing panels 27 and 29 are essentially identical to the panels 21, but as shown, are half size.

Figure 4:
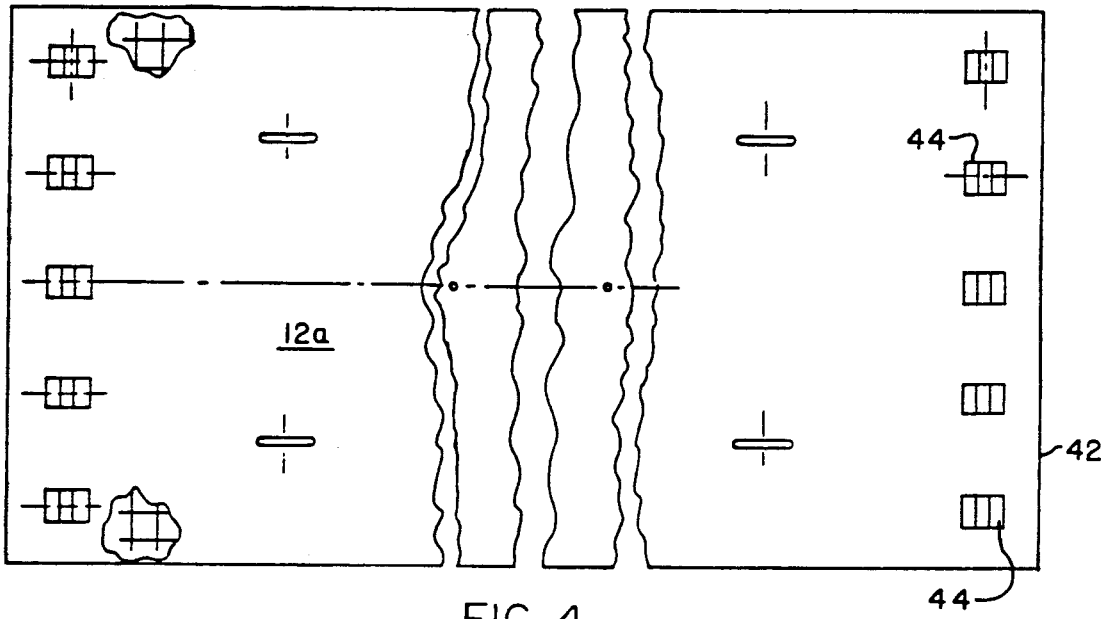
FIGS. 4 and 5 are views of the reinforced concrete floor panels.
Figure 5:
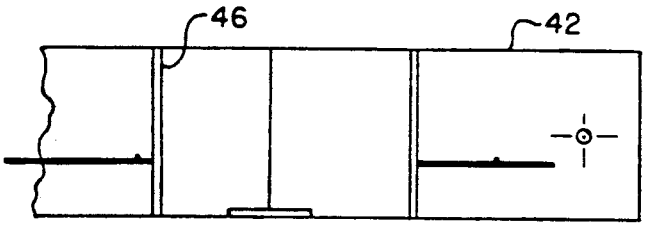

The floor 12 of the building 10 comprises four panels 12*a* and d. Three of the panels 12*a* are identical and are used for all the floor panels except the rear floor panel 12*d*. One of the three identical floor panels 12*a* is shown in FIGS. 4 and 5 and it consists of a steel reinforced concrete slab 42 which is provided with four rectangular openings or receptacles 44 adjacent each side. Each of the openings is lined with a steel box 46 which is open at its top and which is dimensioned to snugly receive the bottom ends of the I-beams 22 of the side wall slabs 21.

Figure 6:
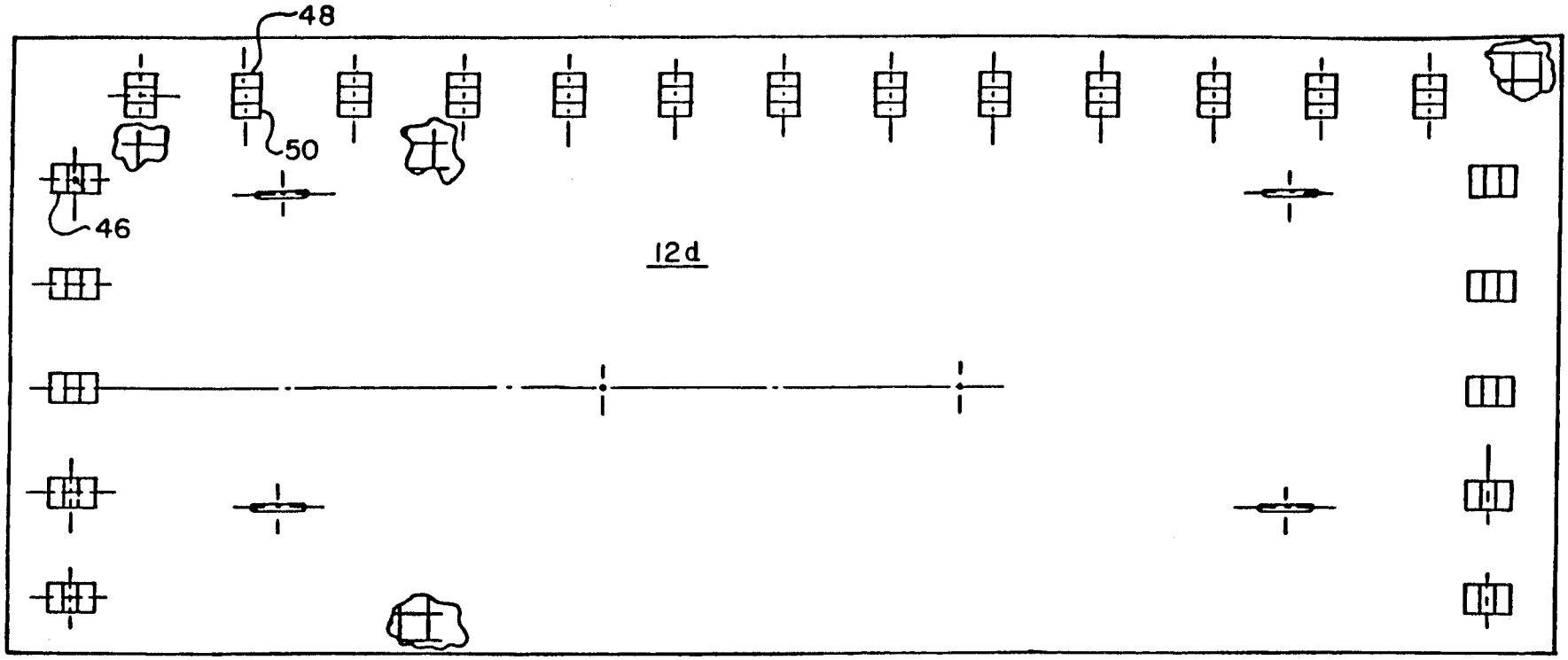
FIG. 6 is a view of the rearmost floor panel.

The rearmost panel 12*d* is shown in FIG. 6 and it is identical to the panels 12*a–c* in all respects, except for the provision of rectangular openings or receptacles 48 which extend across the panel from side wall to side wall. The opening 48 are also lined with steel boxes 50 to accommodate I-beams of the rear panels. The floor slabs 12*a–d* are laid side by side on a prepared level site.

Figure 8:
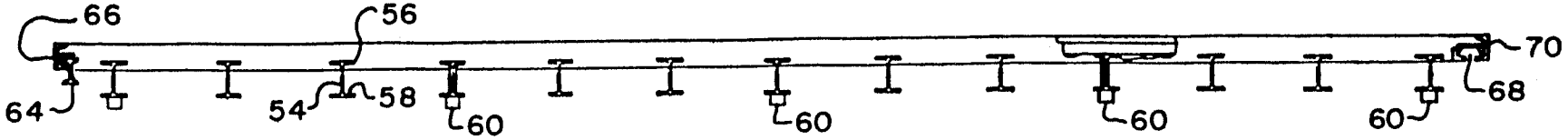
FIG. 7 and 8 show the rear wall assembly.
Figure 7:
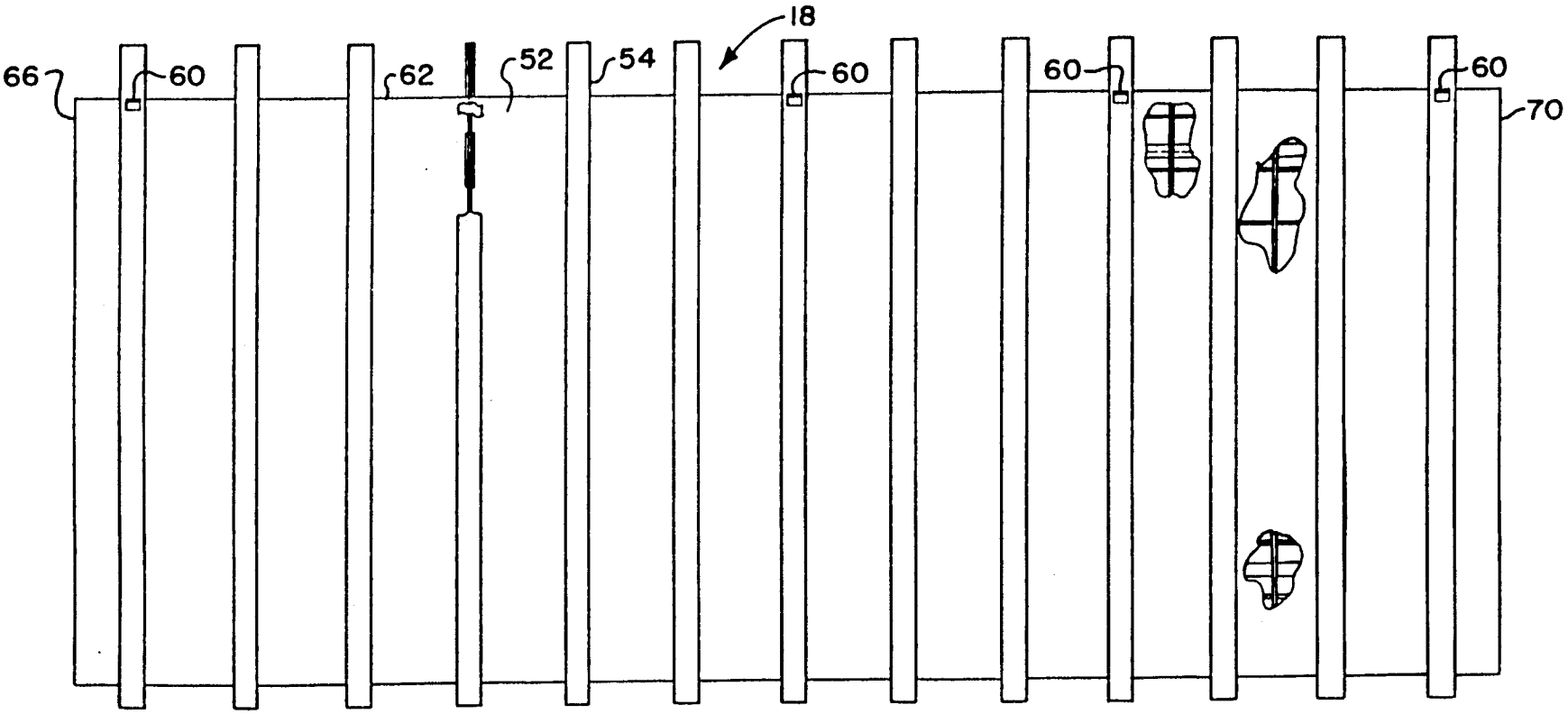
Figure 10:
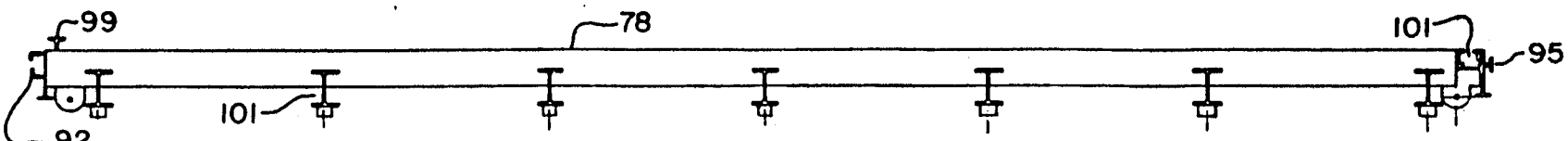
FIGS. 9 to 12 are various views of the door frame.

The rear wall assembly, shown in FIGS. 7 and 8, comprises a single steel reinforced concrete panel 52 in which a plurality of spaced steel I-beams 54 are anchored along the length thereof. As best seen in FIG. 8, one flange 56 of each I-beam 54 is embedded within the concrete panel 52, while the other flange 58 extends out of the panel and lies in a plane parallel to the end walls 18. The I-beams 54 are equally spaced, and as may be seen in FIG. 7, each of them extends above and below the panel 52. For reasons hereinafter to be explained, angle iron members 60 attached to several of the flanges 58, extend therefrom at the height of the top edge 62 of the panel 52. In addition, a flange 64 secured to the rear panel 52 adjacent an end 66 extends from the slab, while a complementary c-channel member 68 is secured to the panel 2 at the other end 70.

Figure 9:
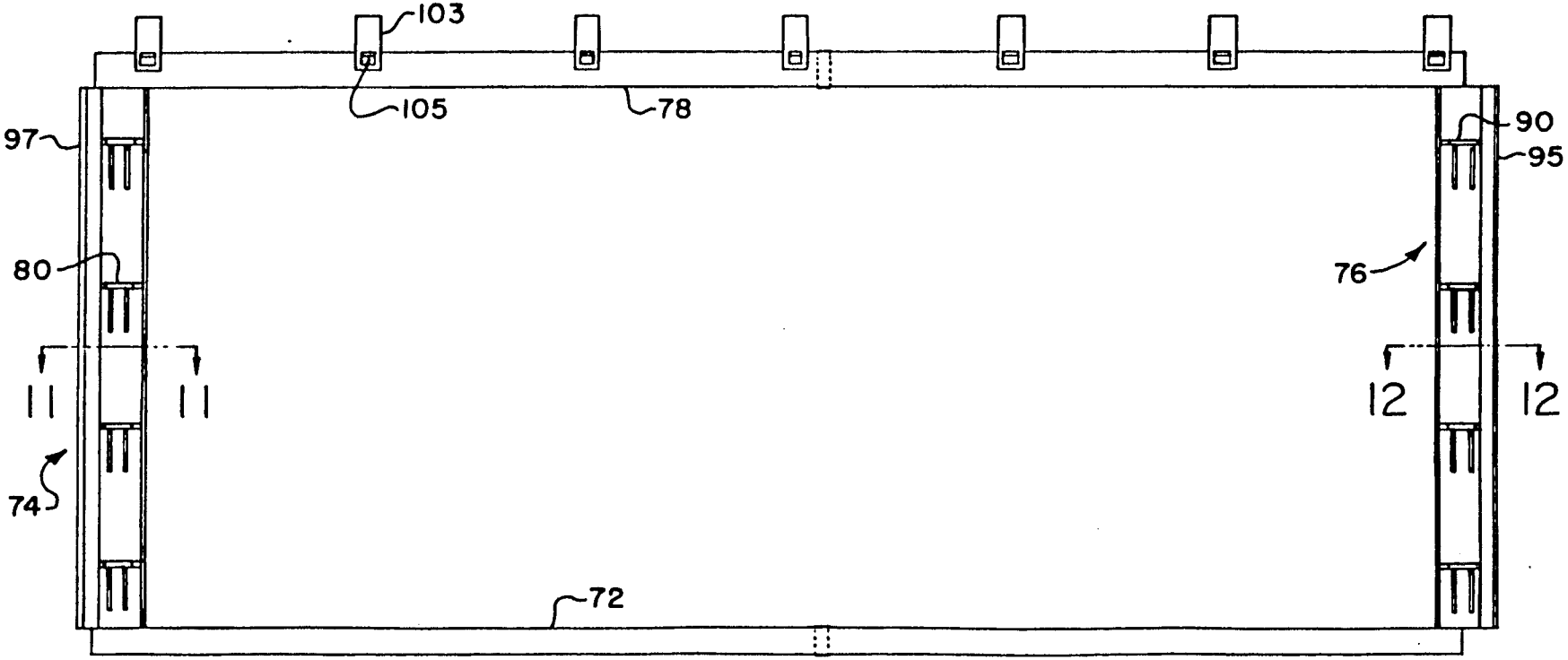

The door frame for the door assembly 20 is shown in FIGS. 9 to 12. As seen in FIG. 9, the frame is comprised of structural steel base member 72, structural steel uprights 74 and 76, and upper frame member 78.

Figure 11:
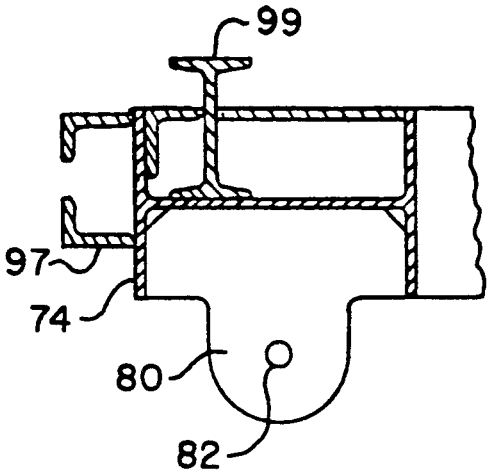
Figure 12:
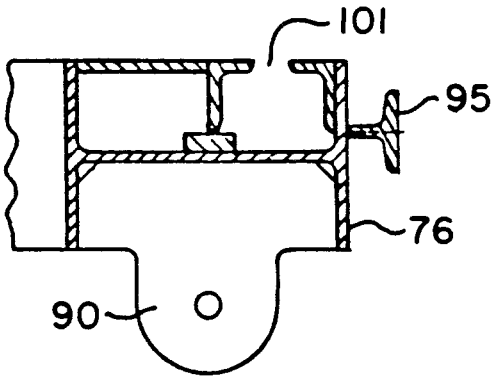

The cross sections of the uprights 74 and 76 are shown in FIGS. 11 and 12. The beam 74 has a number of elements welded to it, including four hinge plates 80 each provided with a hole 82 (See FIG. 11) sized to retain a hinge pins affixed to the doors (not shown in FIGS. 9 to 12). Similarly the beam 76 has four hinge plates 90 welded to it. The hinge plates 90 are provided with hinge pin holes 93. For purposes hereinafter to be explained an elongated channel member 97 is welded to the side of beam 74, while a complimentary flange 95 is welded to the side of beam 76. In addition, the rear of I-beams 74 and 76 are provided with an elongated flange 99 and a complementary channel member 101. For reasons to be explained, a plurality of I-beams 103 are welded to the member 78 and a plurality of equispaced flanges 105 are welded to the upper door frame member 78.

Figure 13:
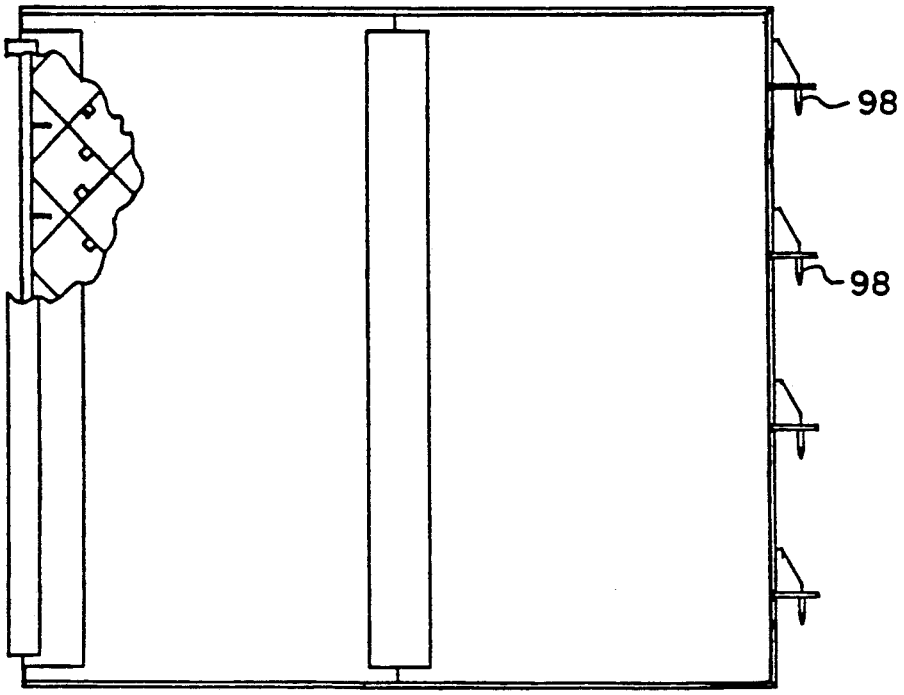
FIGS. 13 and 14 are views of the left and right door assemblies, respectively.
Figure 14:
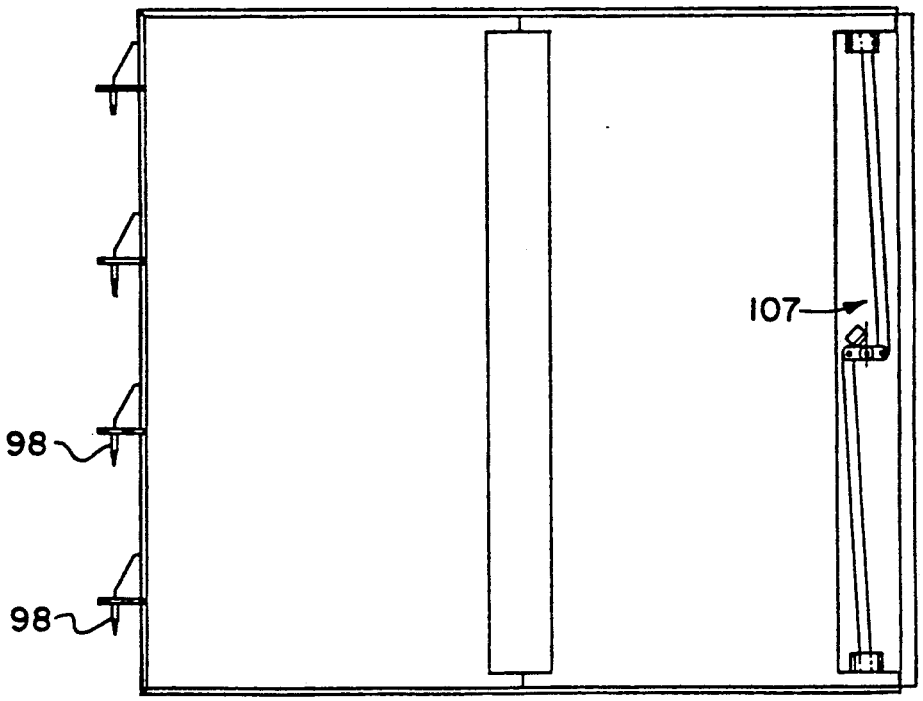

The door assemblies comprise left and right doors 20*a* and 20*b*, shown respectively in FIGS. 13 and 14, and are generally conventional. Both doors are shown as having four hinge pins 98 which are positioned to be received by the holes 82 in the hinge plates 80. The door assembly 20*a* also includes a conventional lock bar and handle assembly 105.

Figure 16:
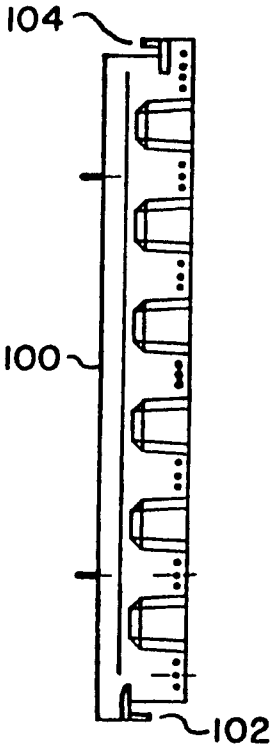
FIGS. 15 and 16 show one of the four identical roof panels.
Figure 15:
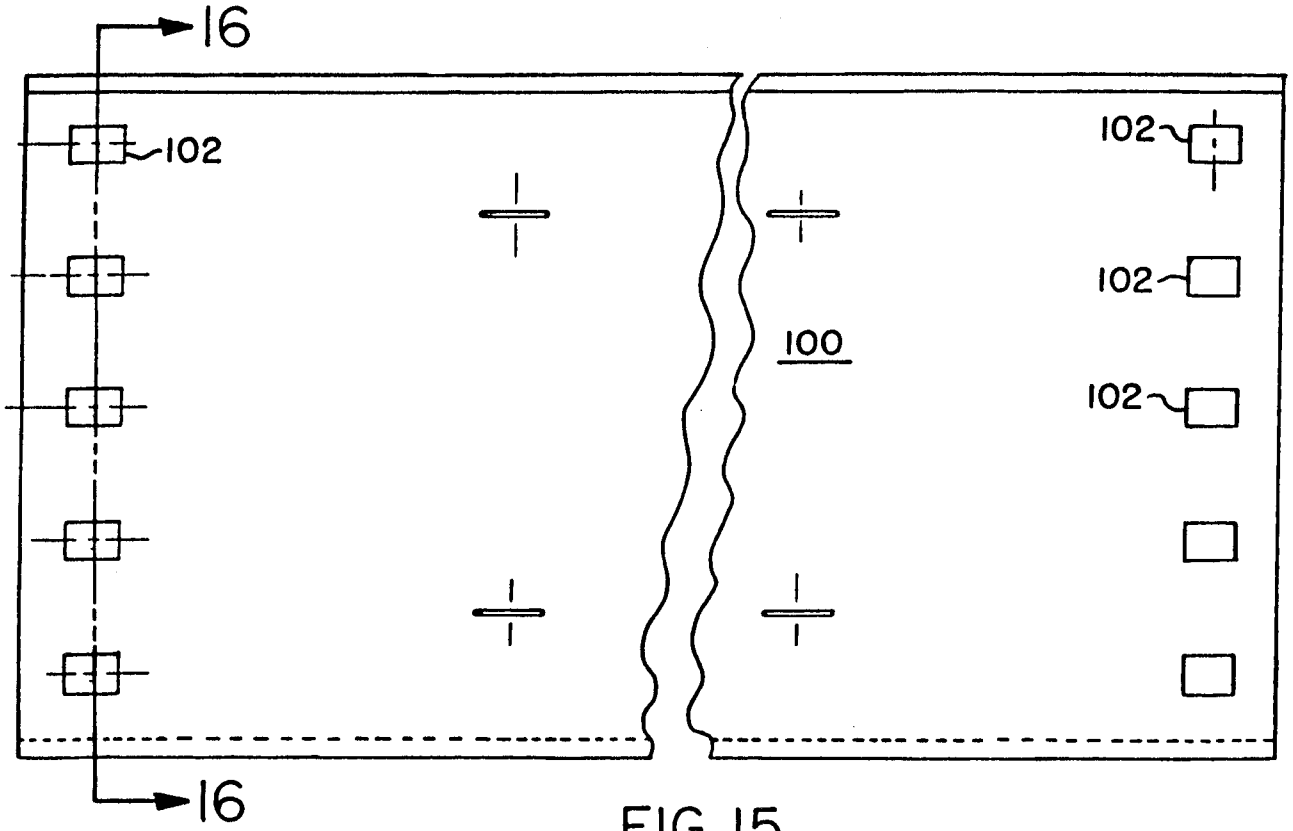

The roof panels 16 comprise 4 identical panels. One of the panels 16 is shown in FIGS. 15 and 16, and it consists of a plurality of steel reinforced concrete slabs 100 which are provided with five openings 102 on each side. These openings do not penetrate the tops of the slabs 100, and each of the openings is lined with a steel liner 104 closed at its top and which is dimensioned to snugly receive the top ends of the I-beams 22 of the side wall sections 21. As shown in FIGS. 15 and 16, the slabs 100 are rectangular and are intended to be mounted side by side with their complementary lap joints 106 and 108 seated in the lap joints of an abutting panels.

Figure 18:
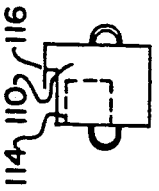
FIGS. 17 and 18 show one of the two quarter panel roof caps mounted over the front door and rear wall, respectively.
Figure 17:
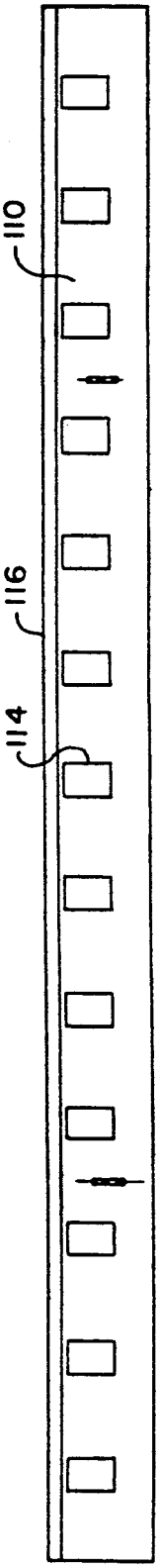

Referring again to FIG. 1, concrete reinforced quarter panels 110 and 112 are used to cap off the front and rear ends of the roof, respectively. The panels 110 and 112 are identical, so that only panel 110 is illustrated in FIGS. 17 and 18. The panels are provided with steel lined openings 114 into which the I-beams 103 of the door frame and the top of the I-beams 54 of the end wall 18 are received.

The quarter panel 110 and 112 are each provided with a lap joint 116 so that the panels can be interlocked with the adjacent lap joint of an abutting roof panel 16.

Figure 20:
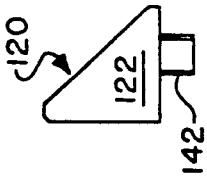
FIGS. 19 and 20 show the earth barricade.
Figure 19:
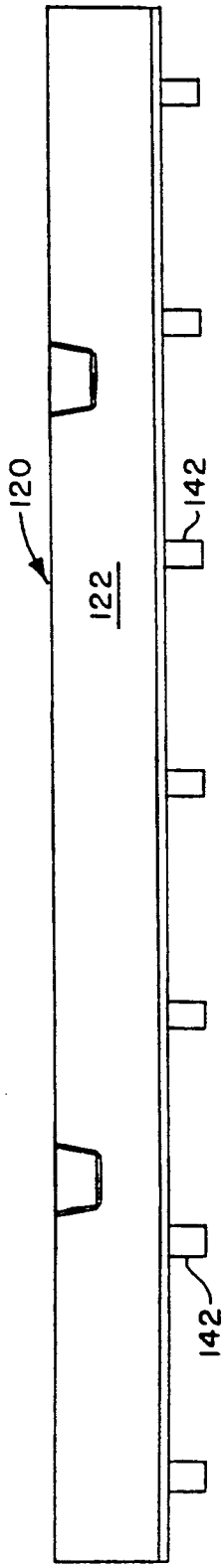

The earth barricade 120 is shown in FIGS. 19 and 20. It comprises a slab 122 of triangular cross section. It has a plurality of I-beams 124 projecting from its bottom and spaced to be inserted into the recesses 114 of quarter panel 110.

Figure 21:
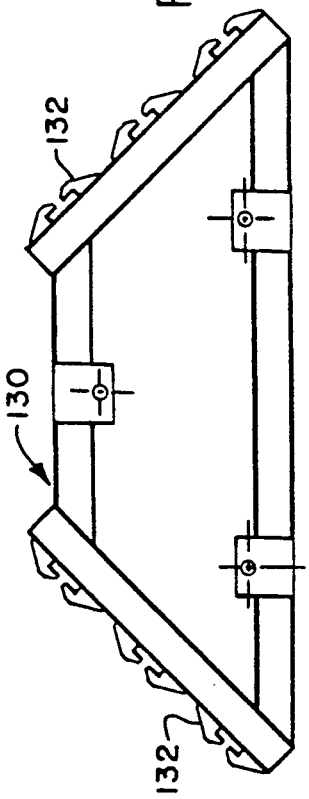
FIG. 21 shows the triangular brace used to brace the building walls and the wing walls.

As seen in FIG. 21, corner braces 130 are used to brace the various walls and to provide earth retention. Although only one brace can be seen in FIG. 1, it will be understood that four are used, one in each corner. The braces 130 each comprises a generally right triangular structure on which channel members 132 are positioned to mate with the flanges of the various corner panels.

ASSEMBLY OF THE BUILDING

The described components can now be assembled. First the ground is leveled to 2 feet below the grade of the floor and 18 inches of sand are added before the floor panels are set in side by side. The lower ends of the sidewall I-beams 22 are then inserted into the steel lined openings 44, the adjacent side wall panels being assembled by sliding the flange 36 located at one edge into the channel member 38 of an adjacent edge. Similarly, the lower ends of the I-beams 54 of the rear wall panel are retained in the steel lined openings 48 in the rear floor panel 12*d*.

The door frame can then be erected by sliding the flange 99 on the back of I-beam 74 into the channel 38 of side wall 21, while the channel 101 on the I-beam 76 is slid over the flange 36 on the side wall 21. The doors 20*a* and 20*b* are then assembled by inserting the hinge pins 98 into the holes 82 in the respective hinge plates 80.

The wall extensions 23, 25, 27 and 29 can now be installed. First, the wall 25 is erected by sliding channel 38 over the flange 95 on the door frame. Next, the wall 29 is installed by sliding its flange 36 into the channel 97 on the other side of the door frame. Similarly, the wall 23 is erected by sliding its flange 36 into the channel 70 of end wall 18, while the channel 38 of wall 27 is slid over the flange 64 on the other side of the end wall 18.

The roof panels 16 are put in place by inserting the upper ends of the I-beams 22 into the steel lined openings 102. The rearmost edge of the rear roof panel is additionally supported by the flanges 60 on the end wall I-beam 54. To provide insulation and to prevent water leakage, various cavities in the assembly may be filled with an insulation foam.

The roof is then capped by the quarter panels and then the earth barricade 120 , and the building is covered with earth extending over the roof and between the wall extensions.

IN SUMMARY

This invention provides a building, the premanufactured components of which can be assembled on site, and which by its nature provides very high integrity of the assembly in the event of explosions occurring within or without the building. The invention is subject to many variations and modifications, and it is intended, therefore, that it be limited only by the scope of the following claims as interpreted in the light of the prior art.

What is claimed is:

1. A prefabricated modular building suitable for storing high energy explosives, said building having a floor, a rear wall, extendable side walls, a roof supported between each side walls, and a full width front door frame, the combination comprising:

a floor comprising a plurality of rectangular floor panels laid side by side on a level foundation, said floor having equi-spaced floor receptacles around the side and rear perimeter thereof, said receptacles being sized for vertically receiving a plurality of a plurality of downward projecting beams;

a plurality of identical aligned side wall panels, said panels having said vertical beams projecting above and below said panels, the lower end of said beams being inserted into said rear wall floor receptacles, said panels also having an elongated flange projecting from one end of each panel and a complementary channel member in the other end of said panel, said flange being inserted into the channel of an abutting panel to interlock adjacent panels;

a plurality of identical interlocked rectangular roof panels extending between and supported by said side wall panels, said roof panels having spaced roof receptacles complementary to the beams of said side wall panels for vertically receiving the upward projecting beams of said side wall panels; and a rear wall panel having vertical beams projecting above and below said panels, the lower end of said beams being inserted into said floor receptacles, said rear wall panels also having an elongated vertically extending flange projecting from said rear wall panel adjacent one end thereof, and a complementary channel member in the other end of said rear wall panel, the flange of said rear wall panel being inserted into the channel of an abutting side wall panel on one side to form one interlocked rear corner, the flange of the other abutting side wall panel being inserted vertically into the channel of said rear wall panel to form a second interlocked rear corner on the other side.

2. The invention as defined in claim 1, and earth retaining means for retaining a layer of earth on the roof of said building and on the outside of the side walls.

3. The invention as defined in claim 2 wherein said earth retaining means comprises:

a triangular barrier having a plurality of equi-spaced receptacles for receiving the upward projecting beams on said door frame, said earth being piled on said roof panels behind said barrier.

4. The invention as defined in claim 1, and a front door frame comprised of first and second spaced vertical beams, one of said beams having a rearward facing flange, the other of said beams having a rearward facing channel member, said flange being inserted into the channel of the adjacent side wall panel, said channel on said other beam receiving the flange of the adjacent panel of the other side wall, whereby a rigid 4 corner, interlocked enclosure with a floor and a roof is provided.

5. The invention as defined in claim 4, and rear wall extension interlocked With and extending from the ends of said rear wall at right angles to said side walls, and door frame extension interlocked with and extending from the ends of said door frame at right angles to said side walls, said rear wall extensions and said door frame extensions providing a retainer for earth piled between said side walls and said extensions.

6. The invention as defined in claim 5 and means for interlocking said extensions and said side walls.

7. The invention as defined in claim 6, wherein said door frame is provided with a plurality of beams extending upward from the top of said frame, and earth retaining means for retaining a layer of earth on the roof of said building and on the outside of the side walls, said earth retaining means comprising a triangular barrier having a plurality of equi-spaced receptacles for receiving said upward projecting beams on said door frame, said barrier retaining earth piled on said roof panels behind said barrier.

8. The invention as defined in claim 1, and rear wall extensions interlocked with and extending from the ends of said rear wall at right angles to said side walls, and door frame extensions interlocked with and extending from the ends of said door frame at right angles to said side walls, said rear wall extensions and said door frame extensions providing a retainer for earth piled between said side walls and said extensions.

9. The invention as defined in claim 8 and means for interlocking said extensions and said side walls.

10. The invention as defined in claim 1 wherein the abutting edges of said roof panels having lap joints, said lap joints interlocking said roof panels.

* * * * *